US006278438B1

(12) United States Patent
Parrott

(10) Patent No.: US 6,278,438 B1
(45) Date of Patent: Aug. 21, 2001

(54) METHOD OF DISPLAYING DIGITAL PHOTOGRAPH BASED BITMAPS

(75) Inventor: Ronald David Parrott, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/264,357

(22) Filed: Mar. 8, 1999

(51) Int. Cl.[7] ..... G09G 5/02

(52) U.S. Cl. ..... 345/150; 345/431; 345/199; 345/22; 345/114; 345/439; 345/147

(58) Field of Search ..... 345/113, 114, 345/439, 150, 147, 199, 22, 72, 83, 88, 431

(56) References Cited

U.S. PATENT DOCUMENTS

| | | | | |
|---|---|---|---|---|
| 4,851,825 | * | 7/1989 | Naiman | 340/728 |
| 5,062,060 | | 10/1991 | Kolnick . | |
| 5,490,245 | | 2/1996 | Wugofski . | |
| 5,600,761 | * | 2/1997 | Ng et al. | 395/128 |
| 5,706,411 | | 1/1998 | McCormick et al. . | |
| 5,727,135 | | 3/1998 | Webb et al. . | |
| 5,910,805 | * | 6/1999 | Hickey et al. | 345/467 |
| 6,038,031 | * | 3/2000 | Murphy | 358/1.09 |
| 6,140,994 | * | 10/2000 | Schaffstein et al. | 345/115 |

* cited by examiner

*Primary Examiner*—Matthew Luu
*Assistant Examiner*—Daniel J Chung
(74) *Attorney, Agent, or Firm*—D. Brent Lambert

(57) ABSTRACT

A method of displaying a visual image includes scaling at least one monochrome digital photograph, scaling at least one non-monochrome icon, and assembling a digital composite display of the at least one scaled monochrome digital photograph and the at least one scaled non-monochrome icon. The digital composite display includes a plurality of monochrome pixel values corresponding to the at least one scaled monochrome digital photograph, and at least one non-monochrome pixel value corresponding to the at least one scaled non-monochrome icon. A composite bitmap is created including a color table having a plurality of color values. Each color value has a plurality of color component intensity values. Each color value corresponds to a respective monochrome pixel value. Selected color values are reserved for non-monochrome colors. Each selected color value is provided with color component intensity values corresponding to a selected non-monochrome pixel value. Monochrome pixel values that correspond to the selected color values reserved for non-monochrome colors are identified. The monochrome pixel values that correspond to the selected color values are changed into other monochrome pixel values that correspond to non-selected color values.

20 Claims, 6 Drawing Sheets

28

| | COLOR VALUE | RED INTENSITY | GREEN INTENSITY | BLUE INTENSITY |
|---|---|---|---|---|
| BLACK (0) | 0000 0000 | 0000 0000 | 0000 0000 | 0000 0000 |
| (1) | 0000 0001 | 0001 1010 | 1111 1111 | 1111 1111 |
| (2) | 0000 0010 | 0000 0010 | 0000 0010 | 0000 0010 |
| (3) | 0000 0011 | 1111 1111 | 1100 1001 | 1111 1111 |
| | ... | ... | ... | ... |
| | 1111 1100 | 1111 1100 | 1111 1100 | 1111 1100 |
| | 1111 1101 | 1111 1101 | 1111 1101 | 1111 1101 |
| | 1111 1110 | 1111 1110 | 1111 1110 | 1111 1110 |
| WHITE (255) | 1111 1111 | 1111 1111 | 1111 1111 | 1111 1111 |

DARKER ← → LIGHTER

COLOR TABLE

Fig. 3

METHOD OF DISPLAYING DIGITAL PHOTOGRAPH BASED BITMAPS

BACKGROUND OF THE INVENTION

1. Field of the Invention

The present invention relates to a method of displaying a digital photograph, particularly on a monitor.

2. Description of the Related Art

A digital photograph can be produced by scanning a photograph and converting it into a matrix of image data. The image data can then be bitmapped into a matrix of pixels which together form a grey-scale image reproduction of the original photograph. The grey-scale image can be displayed on an electronic display device, such as a computer monitor.

A problem when running in either WINDOWS or OS2 is that the grey-scale bitmapping algorithm used with these programs incorporates only a single color table having 256 color value entries. The color table matches each of the 256 monochrome shades of grey that are included in the pixel data with 8-bit color component intensity values for each of red, green and blue. When the intensity values are set equal for each of these three colors, a monochrome shade of grey is produced by the monitor. Use of the color table reduces the amount of data to be stored for each pixel from 24 bits (eight bits for each of red, green and blue) to 8 bits (enough to identify one of the 256 entries in the color table).

The single color table used with WINDOWS or OS2 is just sufficient to accommodate the 256 shades of grey normally used to produce a monochrome display. Thus, there is no allowance in the bitmapping algorithm for including non-monochrome or colored elements within the display of the monochrome image of the digital photograph.

In order to electronically display only a selected object or component from within the photograph, a component bitmap can be cut from the digital photograph based bitmap, converted to monochrome, and edited in other ways by using a bitmap editor and a set of task-specific software tools. The selected component of the photograph can then be displayed against a background chosen by the user, as illustrated by example in FIG. 1. A problem is that the cut edges 10 of the selected component 12 appear to be very jagged, particularly when the cut edges 10 are adjacent to a monochrome background 14. The reduction in quality caused by the jagged edges 10 varies, depending upon the angles of the lines forming the edges of the picture, and the color difference between the picture edge 10 and the background 14.

It is known, in some circumstances, to use a bitmap editor to manually improve the quality of the original component bitmap edges. This approach is not practical, however, for three reasons. First, it is very labor intensive and must be repeated for each component. Second, the edges that are adjacent to the background vary. For example, if a second component that is adjacent to or behind the first component in the photograph is also included in the displayed image, a portion of the edge of the first component will be adjacent to the second component, rather than to the background. Third, different monochrome background colors are used by different host utilities. Thus, for adequate blending of the picture into the monochrome background color, different quality improvements must be made depending upon which monochrome background color is being used. It is possible to scale or reduce the size of the component picture depending on the amount of screen area that is to be dedicated to displaying the picture. In other words, the number of pixels available with which to display the image on the screen may be less than the number of pixels in the original digitized image. Known methods of scaling color bitmaps when the monitor is in "256 color" mode are too slow, or require bitmaps that are too large and/or lacking in quality.

One such known method of scaling is to throw away rows and/or columns of information. This method is very fast, but generally results in very poor quality. Another known method is to use some algorithm such that each pixel in the original image contributes to the value of one or more pixels in the scaled down image. When using this method with a color bitmap, a large "24 bit per pixel" bitmap is required for good quality. When the PC display is in "256 color" mode, the new pixel values that are computed must be mapped to the closest matching color in the system's "256 color" palette. That required color mapping is a very slow process, and the color approximations often result in poor quality.

What is needed in the art is a practical method of assembling, scaling, enhancing and displaying digital photograph quality bitmaps in an environment where the image must change quickly.

SUMMARY OF THE INVENTION

The present invention provides a method of displaying digital photograph based bitmaps in WINDOWS or OS2 such that non-monochrome images can be included in the display of the monochrome digital photograph. The present invention also provides an improved method of smoothing the edges of a cut digital photograph which is being displayed against a monochrome background. Further, the present invention provides an improved method of scaling at least a portion of an image to be displayed. The invention comprises, in one form thereof, a method of displaying a visual image, including scaling at least one monochrome digital photograph, scaling at least one non-monochrome icon, and assembling a digital composite display of the at least one scaled monochrome digital photograph and the at least one scaled non-monochrome icon. The digital composite display includes a plurality of monochrome pixel values corresponding to the at least one scaled monochrome digital photograph, and at least one non-monochrome pixel value corresponding to the at least one scaled non-monochrome icon. A composite bitmap is created including a color table having a plurality of color values. Each color value has a plurality of color component intensity values. Each color value corresponds to a respective monochrome pixel value. Selected color values are reserved for non-monochrome colors. Each selected color value is provided with color component intensity values corresponding to a selected non-monochrome pixel value. Monochrome pixel values that correspond to the selected color values reserved for non-monochrome colors are identified. The monochrome pixel values that correspond to the selected color values are changed into other monochrome pixel values that correspond to non-selected color values.

An advantage of the present invention is that it allows color images to be included in a monochrome display while using only a single color table, as incorporated in a WINDOWS or OS2 bitmapping algorithm.

Another advantage is that the cut edges of a component bitmap can be blended into any monochrome background against which it is displayed with no manual labor being involved.

Yet another advantage is that high quality scaling of portions of the digital image can be performed quickly, and using a minimum of memory storage space.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein:

FIG. 3 is a fragmentary view of a 256 entry color table, as used in one embodiment of the method of the present invention;

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 2:
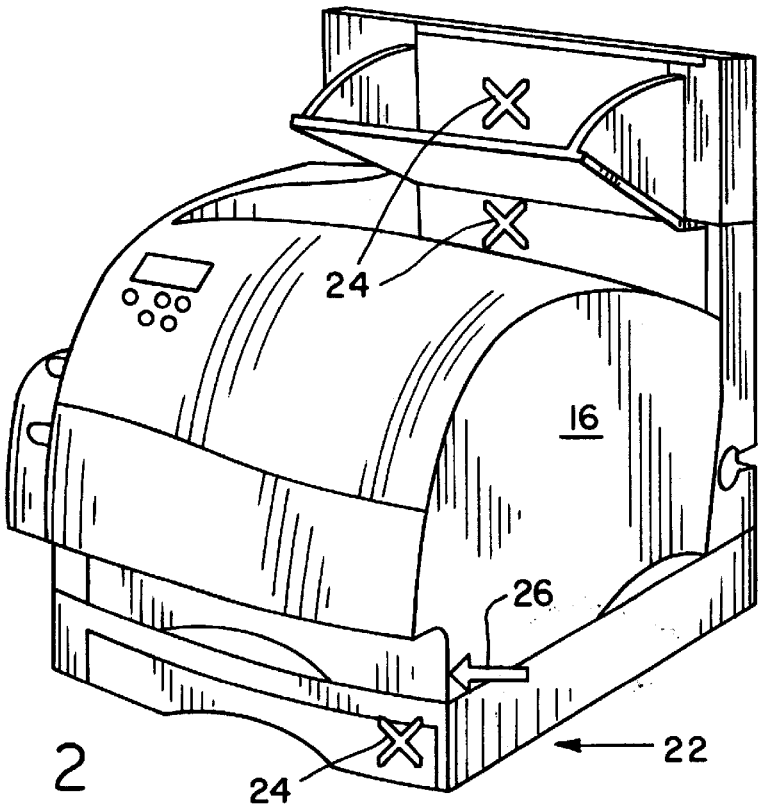
FIG. 2 is a computer monitor display of a monochrome component bitmap, similar to FIG. 1, as well as several non-monochrome icons.

Referring now to the drawings, and particularly to FIG. 2, there is shown a monochrome digital photograph of a printer 16, as displayed on a screen of a computer monitor. The term "monochrome", as used to describe the embodiments herein, is intended to apply to a display composed of black, white and intermediate shades of grey. However, it is to be understood that the term "monochrome" may also encompass a display formed of any other single color, e.g., blue, and shades of that single color.

Several indicators or icons 22, such as crosses 24 and arrow 26, are also included in the display for indicating the status of various parts of printer 16. The "256 color" bitmapping algorithms of Microsoft WINDOWS and OS2 accommodate only a single 256 entry color table, as example of which is referenced 28 in FIG. 3. This 256 entry color table is just large enough to enable the display of the 256 shades of grey which may be present in the monochrome display of printer 16. However, the present invention enables icons 22, such as crosses 24 and arrow 26, to be displayed in colors other than the shades of grey used in the display of printer 16, even while running in WINDOWS or OS2. One embodiment of the method of the present invention, allowing non-monochrome icons 22 to be included in a composite display that also includes a monochrome image of a digital photograph, will now be described in more detail. First, only the monochrome parts of the picture, such as printer 16, are assembled and scaled in memory. Such components are generated from digital photographs, and therefore contain numerous monochrome shades. The method of scaling the monochrome components can be a variation of the known method described above, in which each pixel in the original image contributes to the value of one or more pixels in the scaled down image. All non-monochrome (color) considerations are initially ignored in this step. The pixel data portion of a relatively small "8 bit per pixel" monochrome bitmap is built in memory. No slow "closest matching color" software is needed, since for this step only the complete set of 256 monochrome colors are assumed to be available.

Finally, provisions are made for the color information that is to follow. The "8 bit per pixel" monochrome bitmap includes color table 28, which has 256 8-bit color value entries. Color table 28 associates each of the 256 8-bit color value entries with a set of three 8-bit color component intensity values, i.e., one for each of red, green and blue. In this application, each of the three color intensity values corresponding to a given color value are set to an equal color intensity value, thereby producing a monochrome shade of grey. The color intensity values sequentially increase from 0 (black) to 255 (white). This intensity increase appears to be non-linear to the human eye in the dark end of the scale. That is, the color values near 0 all appear to be black.

The present invention takes advantage of the above-described perceived non-linearity by using some of these "almost black" color table entries for displaying a few selected non-monochrome colors. More particularly, the odd numbered values of the color table that are near 0 are assigned non-monochrome color component intensity values. For instance, the color value "1" is shown in FIG. 3 to be associated with a specific, non-equal set of three color component intensity values. This set of three component intensity values can subsequently be used to display a specific color, such as a shade of red, to form one of icons 22. Similarly, the color value "3" is associated with another non-equal set of three color component intensity values which can be used to display another specific color.

The monochrome components of the digital photograph of printer 16 were previously scaled, as described above, with the assumption that a standard monochrome color table would be used in the scaling. However, with the non-monochrome modifications to the odd, "near black" color values in color table 28, it is possible for these non-monochrome colors to contaminate the otherwise monochrome display of printer 16. For instance, some new pixel values that are computed by the monochrome scaled down algorithm may be "odd numbered values near 0", which are color values reserved for non-monochrome colors.

The method of the present invention avoids this problem by changing any pixel color value that is one of the "odd numbered values near 0" to another color value in color table 28 that is still associated with three equal component color intensities which combine to produce a shade of grey. In order avoid a perceived change in the shade of grey of the pixels, the pixel color values that are one of the "odd numbered values near 0" are each decremented or incremented by the minimum amount possible, i.e., by one color value. For example, a pixel color value of 1 can be decremented to 0, and a pixel color value of 3 can be decremented to 2. Since these color values all appear to be black, no change in the color of the pixel can be perceived, and no noticeable loss of quality is introduced. Thus, the method of the present invention takes advantage of the speed, efficiency and high quality of a state of the art monochrome scale down algorithm while still allowing for color information to be included in the bitmap.

Another embodiment of the present invention provides a method of scaling down the monochrome components 12 or icons 22 of a composite display. A scaling method described above, wherein each pixel in the original image contributes to the value of one or more pixels in the scaled down image, has the disadvantage of being very computationally intensive, and therefore time-consuming. The method of the present invention avoids this disadvantage by performing the scaling manually before it is needed, and then storing the resulting bitmaps for retrieval and use when the bitmaps are needed.

Figure 4:
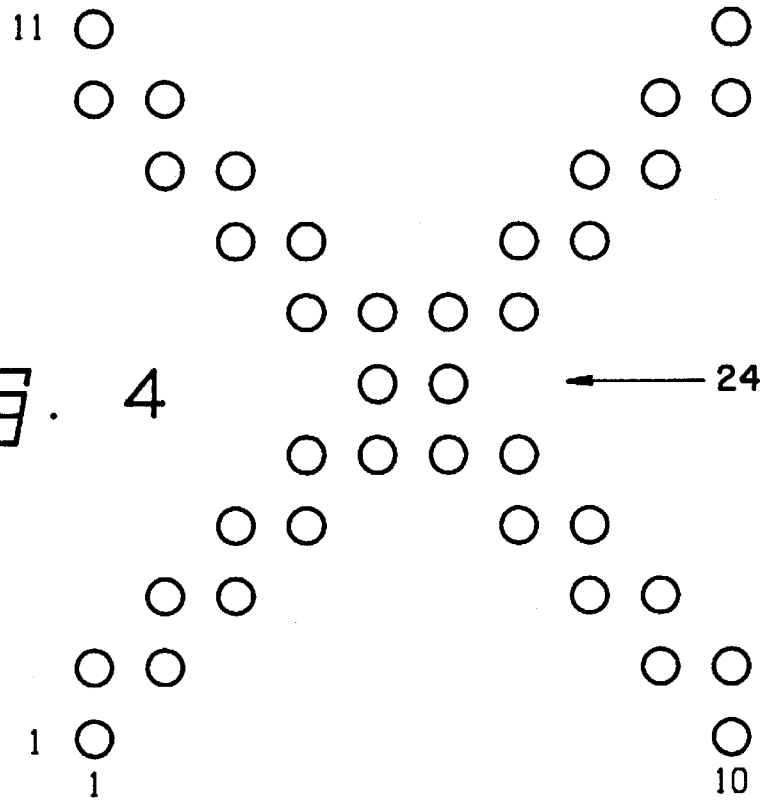
FIG. 4 is a magnified view of the cross-shaped, non-monochrome icon of FIG. 2.
Figure 5:
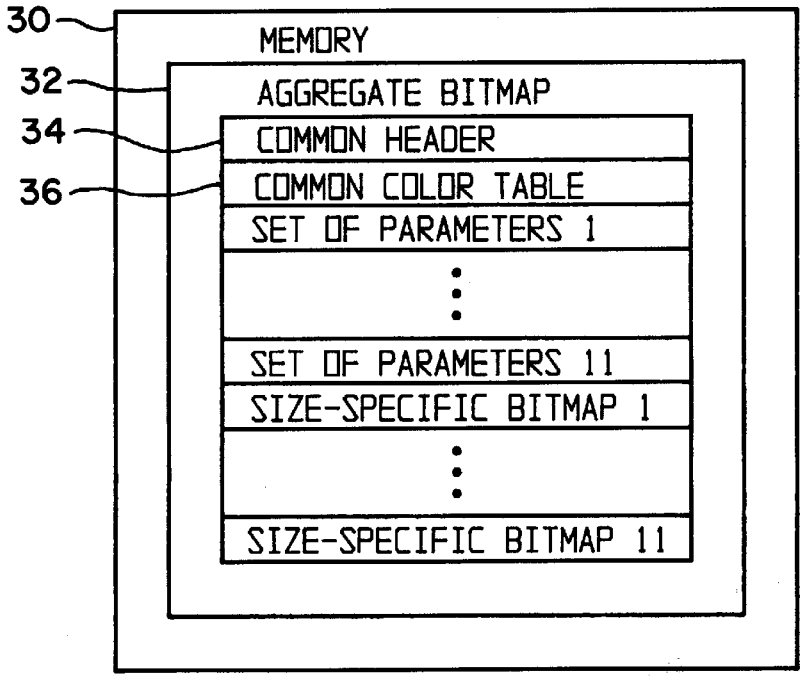
FIG. 5 is a block diagram of an aggregate bitmap used in another embodiment of the method of the present invention.

More particularly, every possible alternative size in which a component 12 or icon 22 can be displayed is determined. For example, a magnified cross 24 is shown in FIG. 4, measuring ten pixels by eleven pixels. Cross 24 can be scaled down a maximum of ten times, thereby forming eleven alternative display sizes with heights ranging from one pixel to eleven pixels. A respective size-specific bitmap is formed for each of these eleven alternative sizes, and each size-specific bitmap is stored in a memory device 30 (FIG. 5) as part of an aggregate bitmap 32.

In order to minimize the amount of memory space conjunctively occupied by the size-specific bitmaps, aggregate bitmap 32 is provided with a common set of header information 34 that can be shared by each of the size-specific bitmaps. Common header information 34 can include the format in which the pixel data of each size-specific bitmap is stored. A common color table 36 is also shared by each of the size-specific bitmaps.

A respective set of parameters is established for each size-specific bitmap and is stored in memory 30, thereby serving as an additional header. The set of parameters can include the number of pixel data bytes for the corresponding size-specific bitmap, the size-specific bitmap width in pixels, the size-specific bitmap height in pixels, and the address in memory device 30 of the start of pixel data for the corresponding size-specific bitmap.

When one of the alternative display sizes has been selected or otherwise determined, a set of parameters is identified which corresponds to the selected display size. The identified set of parameters points to the address of the pixel data for the size-specific bitmap which corresponds to the selected display size. The pixel data is arranged in a pattern that allows the data to be sequentially copied from aggregate bitmap 32 into a final bitmap. The copying is performed in a manner dependent upon and according to the information in the corresponding set of parameters. Finally, the final bitmap is mapped into a set of pixels to be displayed on a screen of a monitor.

This embodiment of the present invention is particularly well suited for relatively small images, such as icons 22. Substantial amounts of computation time is saved by forming the size-specific bitmaps before they are needed and saving them for future retrieval and use. Also, the size-specific bitmaps of these small non-monochrome images do not occupy an excessive amount of memory space when stored in the aggregate bitmap of the present invention.

Figure 1:
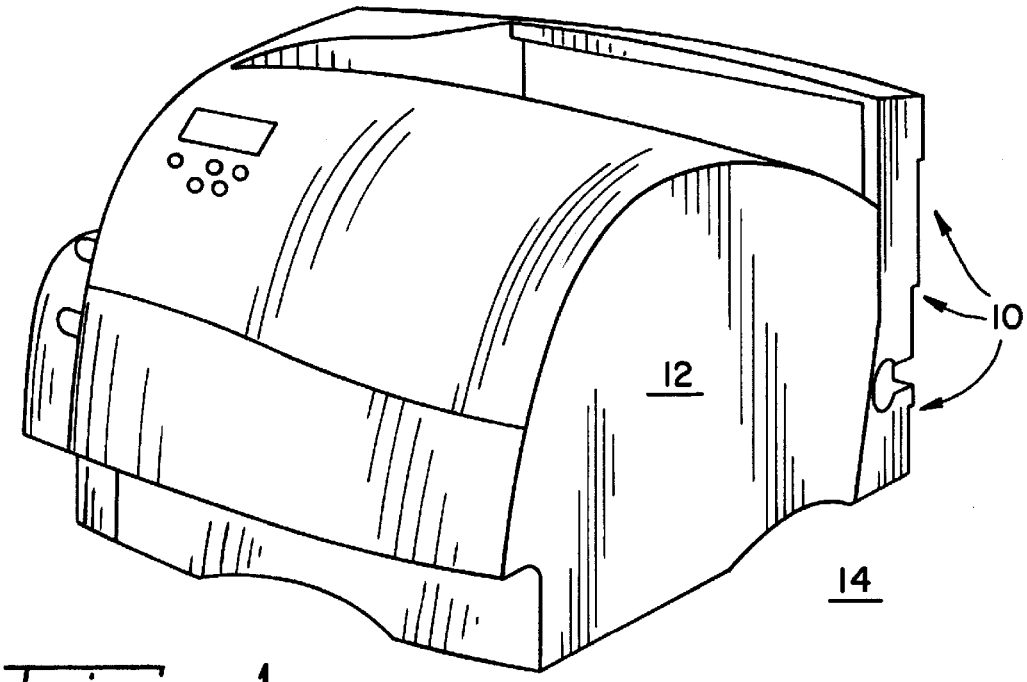
FIG. 1 is a drawing of a display of a monochrome component bitmap which has been cut from a bitmap originating from a digital photograph and displayed against a monochrome background, before any smoothing has been performed.

Yet another embodiment of the present invention provides a method of smoothing the jagged appearance of the cut edges of monochrome component bitmaps, which cut edges are shown in FIG. 1. According to the method, background pixels that are adjacent to the cut edges are given intermediate color values that are between the color values of the component's cut edges and other background pixels.

Figure 6:
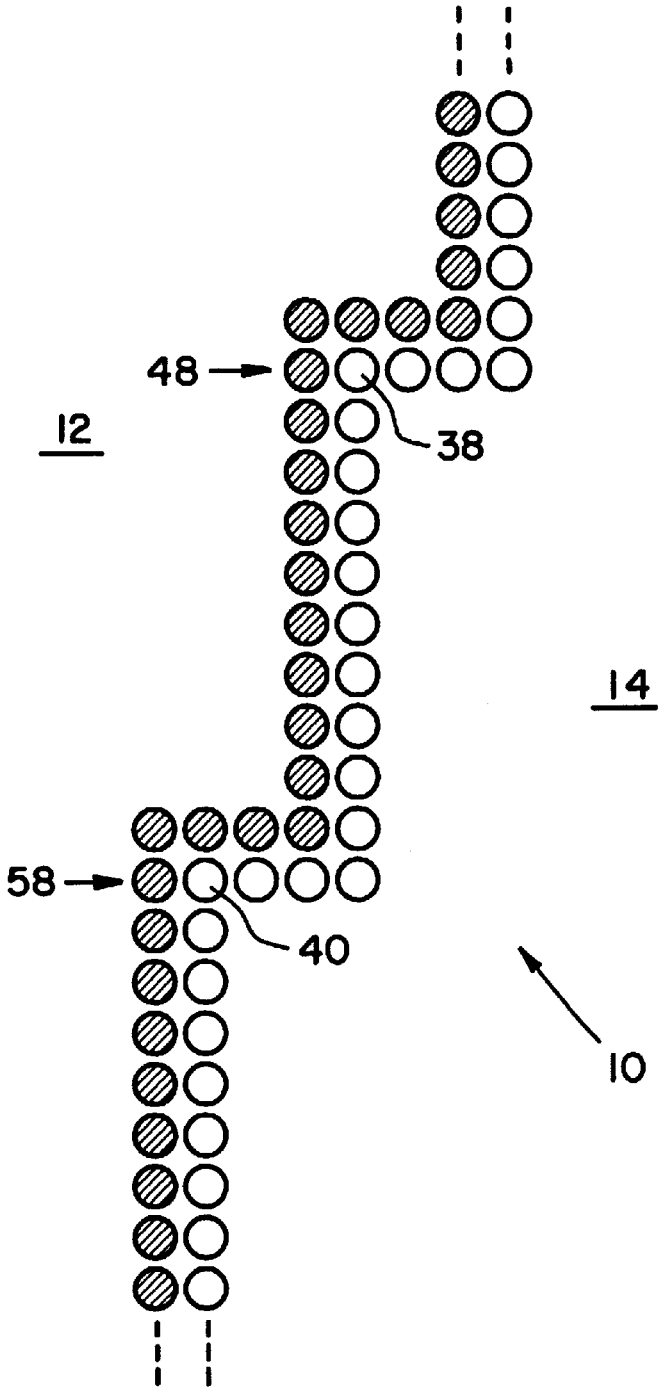
FIG. 6 is a diagram showing individual pixels of a magnified portion of the right-hand cut edge of FIG. 1.

A magnified diagram of the right-hand cut edge of FIG. 1 is shown in FIG. 6. The jagged cut edge 10 is represented by a series of cross-hatched component pixels. An adjacent line of background pixels is shown without any cross-hatching. Additional component pixels are present to the left of the shown component pixels, and additional background pixels are present to the right of the shown background pixels. However, in order to avoid cluttering of the diagram, these additional pixels are not included in FIG. 6. The component pixels and background pixels together form the complete displayed image, and are conjunctively referred to herein as image pixels. As may be ascertained from FIG. 6, the image pixels are arranged in matrix of vertically aligned columns and horizontally aligned rows. Each image pixel, with the exception of image pixels on the outside edge of the display, has four "adjacent" image pixels, i.e., one pixel directly above, one pixel directly below, one pixel directly to the left, and one pixel directly to the right.

Two "corner" background pixels 38 and 40 can be identified in FIG. 6. Such corner background pixels are characteristically adjacent to at least two component pixels. All other background pixels shown in FIG. 6 are adjacent to less than two component pixels.

Figure 7:
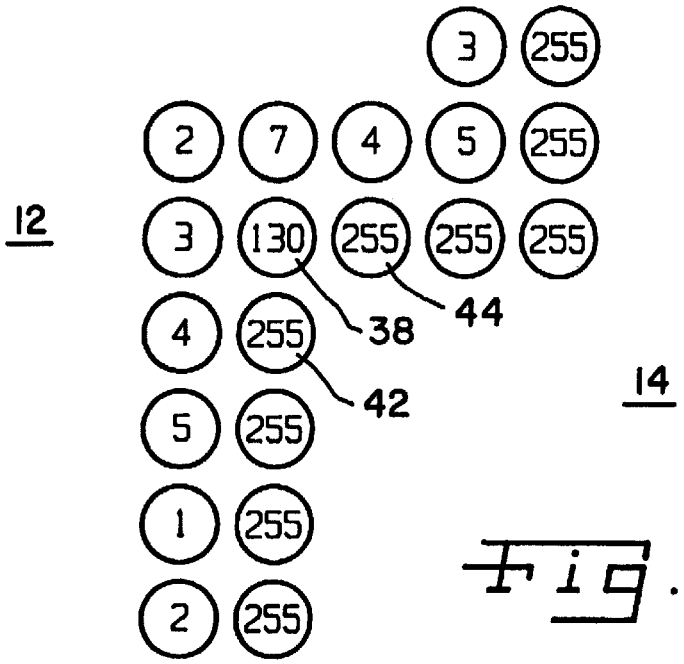
FIG. 7 is a further magnified diagram of a subset of the pixels of FIG. 6, showing color values of each pixel, and particularly a modified corner background pixel color value.

One embodiment of the method of the present invention will be described with reference to FIG. 7, which is a diagram of corner pixel 38 and some surrounding other image pixels. Inside each pixel of FIG. 7 is a number representing a monochrome color value associated with the pixel. The color values can range from 0 to 255, indicating black and white, respectively. For clarity of illustration, it is assumed that each background pixel initially has a color value of 255 (white). Also, each component pixel has a color value approximately between 0 and 10 (very close to black). Such a contrast between the color values of the component pixels and the adjacent background pixels causes the cut edge of the digital photograph to have an undesirably jagged appearance.

In order to smoothen the transition between the component pixels and the background pixels, the color values of the corner background pixels are modified or changed to an intermediate color value. This intermediate color value is interpolated between the color values of the adjacent component pixels and background pixels in order to arrive at a color value somewhere in between.

In the embodiment shown in FIG. 7, the color value of corner pixel 38 is modified to be the mathematical average of its four adjacent pixels. That is, the sum of the color values of the four adjacent pixels is divided by four [(3+7+255+255)/4=130].

Each of the two background pixels 42 and 44 that are adjacent to corner pixel 38 are referred to herein as "semi-corner " background pixels. Such semi-corner background pixels are characteristically adjacent to at least one component pixel, and to at least one corner background pixel, or at least one other background pixel that has been previously identified as a semi-corner pixel.

Figure 8:
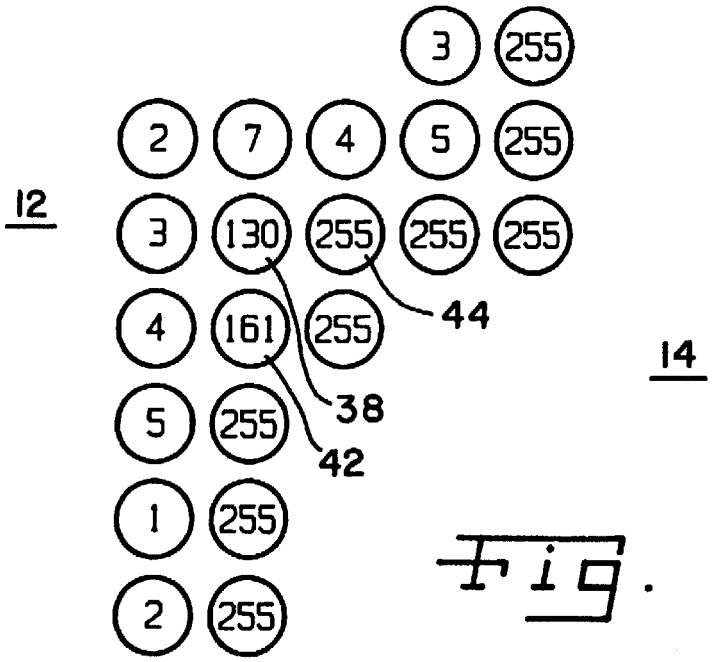
FIG. 8 is a diagram similar to FIG. 7, showing a modified semi-corner background pixel color value.

In FIG. 8, the color value of semi-corner pixel 42 is modified in the same manner that the color value of corner pixel 38 was modified in FIG. 7. That is, the color value of semi-corner pixel 42 is modified to be equal to the sum of the color values of the four adjacent pixels divided by four [(4+130+255+255)/4=161].

Figure 9:
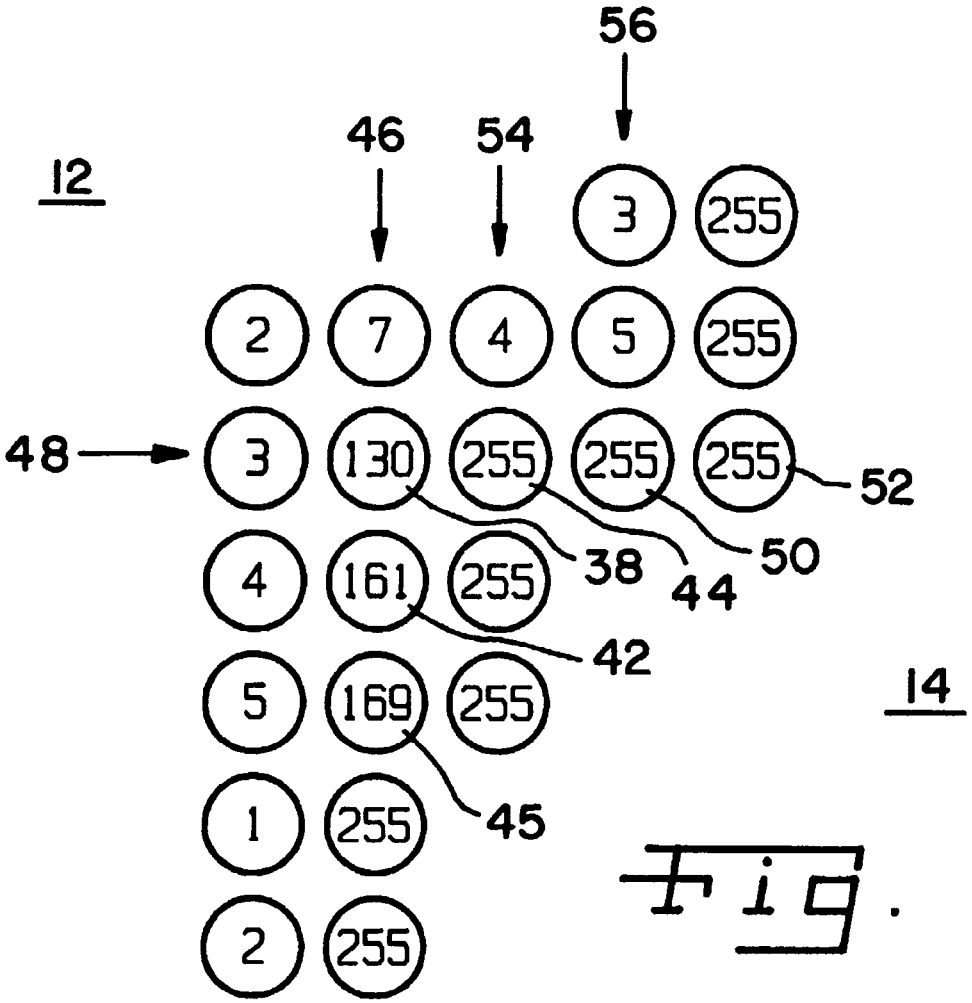
FIG. 9 is a diagram similar to FIGS. 7 and 8, showing another modified semi-corner background pixel color value.

FIG. 9 illustrates the result of the modification of the color value of the next semi-corner background pixel 45 along column 46. The process of modifying semi-corner pixel color values is also continued along row 48, away from corner pixel 38, for pixels 44 and 50 in sequence. Background pixel 52 is not a semi-corner pixel, however, since it is not adjacent to a component pixel, and its color value is therefore not modified in this embodiment. As the color value modifications progress in directions away from the corner pixels, the modified color values become closer to the color values of the background pixels and further from the color values of the component pixels. Thus, the cut edge of the component 12 is no longer clearly visible as it appears to gradually fade into background 14.

In another embodiment, the color value modifying technique described above is continued downward along columns 54 and 56 in sequence for background pixels approximately between row 48 and row 58, where the next "step" occurs in cut edge 10. These additional color value modifications would further extend the transition between cut edge 10 and background 14, thereby providing component 12 with a more desirable appearance. The technique for modifying or interpolating color values that is used in the embodiment of FIGS. 7–9 includes computing an average of the four adjacent color values. However, it is to be understood that other mathematical interpolation techniques may also be used. For example, a weighted average which is dependent upon the distance of the background pixel from the corner background pixel may also be used.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method of displaying a visual image, comprising the steps of:

providing at least one monochrome digital photograph;

scaling said at least one monochrome digital photograph;

providing at least one non-monochrome icon;

scaling said at least one non-monochrome icon;

assembling a digital composite display of said at least one scaled monochrome digital photograph and said at least one scaled non-monochrome icon, said digital composite display including a plurality of monochrome pixel values corresponding to said at least one scaled monochrome digital photograph and at least one non-monochrome pixel value corresponding to said at least one scaled non-monochrome icon; and creating a composite bitmap including a color table having a plurality of color values, each said color value having a plurality of color component intensity values, each said color value corresponding to a respective said monochrome pixel value, said creating step including the substeps of:

reserving selected said color values for non-monochrome colors;

providing each said selected color value with color component intensity values corresponding to a selected said non-monochrome pixel value;

identifying said monochrome pixel values that correspond to said selected color values reserved for non-monochrome colors; and changing said monochrome pixel values that correspond to said selected color values into other said monochrome pixel values that correspond to non-selected said color values.

2. The method of claim 1, wherein said color values corresponding to monochrome pixel values range from black to white, said selected color values reserved for non-monochrome colors corresponding to monochrome pixels values that are substantially closer to black than to white.

3. The method of claim 1, wherein said substep of changing said monochrome pixel values includes one of incrementing and decrementing said monochrome pixel values by one.

4. The method of claim 1, wherein each said color value reserved for a non-monochrome color is spaced from every other said color value reserved for a non-monochrome color by at least two said color values.

5. A method of displaying a visual image, comprising the steps of:

determining a plurality of alternative sizes in which the visual image can be displayed;

creating an aggregate bitmap encompassing each of said alternative display sizes of the visual image, said step of creating an aggregate bitmap including the substeps of:

scaling the visual image to produce a size-specific bitmap corresponding to a selected one of said alternative sizes in which the visual image can be displayed;

establishing a set of parameters corresponding to said size-specific bitmap;

storing each of said size-specific bitmap and said corresponding set of parameters in a memory device;

repeating said scaling, establishing and storing substeps for each remaining said alternative display size;

providing a common set of header information applying to each said size-specific bitmap; and providing a common color table applying to each said size-specific bitmap;

selecting one of said alternative display sizes in which the visual image is to be displayed;

identifying from said aggregate bitmap a selected said set of parameters and a selected said size-specific bitmap corresponding to said selected display size;

sequentially copying pixel data from said selected size-specific bitmap from said aggregate bitmap into a final bitmap dependent upon said selected set of parameters; and mapping said final bitmap into a set of pixels to be displayed.

6. The method of claim 5, wherein each said set of parameters includes at least one of:

a number of pixel data bytes in a corresponding said size-specific bitmap;

a width in pixels of a corresponding said size-specific bitmap;

a height in pixels of a corresponding said size-specific bitmap; and an address of a start of said pixel data of a corresponding said size-specific bitmap in said aggregate bitmap.

7. The method of claim 5, wherein said set of creating an aggregate bitmap includes the substep of storing said common set of header information and said common color table in said memory device.

8. The method of claim 5, wherein said step of selecting one of said alternative display sizes sequentially follows said step of creating an aggregate bitmap.

9. The method of claim 5, wherein said common set of header information includes a format of said pixel data.

10. A method of displaying a portion of a digital photograph, comprising the steps of:

creating a bitmap of the digital photograph;

extracting a component bitmap from said bitmap of the digital photograph, said component bitmap corresponding to a set of component pixels;

providing a background bitmap corresponding to a set of background pixels, said background pixels surrounding said component pixels;

identifying corner ones of said background pixels, said corner background pixels each being adjacent to at least two individual said component pixels and at least one other said background pixel;

modifying a respective color value of each said corner background pixel;

ascertaining semi-corner ones of said background pixels, said semi-corner background pixels each being adjacent to at least one said component pixel, at least one said corner pixel and at least one other said background pixel; and modifying a respective color value of each said semi-corner background pixel.

11. The method of claim 10, wherein said modifying step includes interpolating a respective color value for each said corner background pixel, said interpolated color value being interpolated between said color values of said at least two adjacent component pixels and said at least one adjacent other background pixel.

12. The method of claim 11, wherein said interpolating step includes computing a mathematical average of said color values of said at least two adjacent component pixels and said at least one adjacent other background pixel.

13. A method of displaying a portion of a digital photograph, comprising the steps of:

creating a bitmap of the digital photograph;

extracting a component bitmap from said bitmap of the digital photograph, said component bitmap corresponding to a set of component pixels;

providing a background bitmap corresponding to a set of background pixels, said background pixels surrounding said component pixels;

identifying corner ones of said background pixels, said corner background pixels each being adjacent to at least two individual said component pixels and at least one other said background pixel;

modifying a respective color value of each said corner background pixel, said modified color value being dependent upon color values of said at least two adjacent component pixels and said at least one adjacent other background pixel;

ascertaining semi-corner ones of said background pixels, said semi-corner background pixels each being adjacent to at least one said component pixel, at least one said corner pixel and at least one other said background pixel; and modifying a respective color value of each said semi-corner background pixel, said modified color value of each said semi-corner pixel being dependent upon color values of said at least one adjacent component pixel, said at least one adjacent corner pixel and said at least one adjacent other background pixel.

14. The method of claim 13, wherein said steps of ascertaining semi-corner background pixels and modifying a color value of each said semi-corner background pixel sequentially follow said steps of identifying corner background pixels and modifying a color value of each corner background pixel.

15. The method of claim 14, wherein said step of modifying a color value of each said semi-corner background pixel is performed on said semi-corner background pixels in a sequence dependent upon a proximity of each said semi-corner background pixel to one of said corner background pixels.

16. The method of claim 10, comprising the further step of merging said component pixels with said background pixels to form a set of image pixels, said image pixels being arranged in a matrix of vertically aligned columns and horizontally aligned rows.

17. The method of claim 16, wherein each said image pixel has a maximum of four adjacent said image pixels.

18. The method of claim 17, wherein said four adjacent image pixels include two horizontally adjacent said image pixels and two vertically adjacent said image pixels.

19. The method of claim 10, wherein said modified color value of each said corner background pixel is dependent upon color values of said at least two adjacent component pixels and said at least one adjacent other background pixel.

20. The method of claim 10, wherein said modified color value of each said semi-corner pixel is dependent upon color values of said at least one adjacent component pixel, said at least one adjacent corner pixel and said at least one adjacent other background pixel.

* * * * *